US011629606B2

(12) United States Patent
Healy et al.

(10) Patent No.: US 11,629,606 B2
(45) Date of Patent: Apr. 18, 2023

(54) SPLIT-LINE STATOR VANE ASSEMBLY

(71) Applicant: General Electric Company, Schenectady, NY (US)

(72) Inventors: Michael James Healy, Greenville, SC (US); Sabarinath Devarajan, Bangalore (IN); Carlos Alberto Cardoza, Houston, TX (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/389,562

(22) Filed: Jul. 30, 2021

(65) Prior Publication Data

US 2022/0381150 A1 Dec. 1, 2022

(30) Foreign Application Priority Data

May 26, 2021 (IN) ..... 202111023487

(51) Int. Cl.
*F01D 9/02* (2006.01)

(52) U.S. Cl.
CPC ..... *F01D 9/02* (2013.01); *F05D 2220/32* (2013.01)

(58) Field of Classification Search
CPC ..... F01D 9/02; F05D 2220/32
USPC ..... 415/208.1
See application file for complete search history.

(56) References Cited

U.S. PATENT DOCUMENTS 2,772,069 A * 11/1956 Hockert ..... F01D 9/042 415/134
3,026,087 A * 3/1962 Welsh ..... F01D 9/042 415/173.5
3,070,352 A * 12/1962 Welsh ..... F01D 9/041 24/69 R
3,079,128 A * 2/1963 Burge ..... F01D 17/162 415/174.4
3,849,023 A * 11/1974 Klompas ..... F01D 9/042 415/173.7
3,918,832 A * 11/1975 Shuttleworth ..... F01D 9/042 415/209.2
4,285,633 A * 8/1981 Jones ..... F01D 25/06 415/191
4,395,195 A * 7/1983 De Cosmo ..... F01D 17/162 415/137
4,792,277 A * 12/1988 Dittberner, Jr. ..... F01D 17/162 415/190

(Continued)

*Primary Examiner* — Hung Q Nguyen
*Assistant Examiner* — Anthony Donald Taylor, Jr.
(74) *Attorney, Agent, or Firm* — Dority & Manning, P.A.

(57) ABSTRACT

A compressor section includes a compressor casing that has an upper casing portion coupled to a lower casing portion such that a split-line is defined between the upper casing portion and the lower casing portion. A split-line stator vane assembly includes a first split-line stator vane that has a first shank with a first platform portion and a first mounting portion extends radially outward of the first platform portion. A first airfoil extends radially inward of the platform portion. The first platform portion includes a protrusion that extends circumferentially beyond the split-line. A second split-line stator vane having second shank with a second platform portion and a second mounting portion extends radially outward of the second platform portion. A second airfoil extends radially inward of the second platform portion. The second platform portion includes a recess that extends circumferentially away from the split-line.

18 Claims, 7 Drawing Sheets

(56) References Cited

U.S. PATENT DOCUMENTS 5,788,456 A * 8/1998 Maier ..... F01D 9/042 29/889.22
6,196,794 B1 * 3/2001 Matsumoto ..... B29C 66/543 416/241 A
6,425,738 B1 * 7/2002 Shaw ..... F01D 9/041 415/209.2
6,733,237 B2 * 5/2004 Ingistov ..... F04D 29/322 29/889.22
6,910,854 B2 * 6/2005 Joslin ..... F01D 11/005 415/191
7,946,808 B2 * 5/2011 Taylor ..... F01D 11/001 416/193 A
8,092,165 B2 * 1/2012 Bouchard ..... F01D 9/02 29/889.22
8,128,354 B2 * 3/2012 Hansen ..... F04D 29/542 415/209.3
8,381,379 B2 * 2/2013 Holmes ..... F04D 29/542 29/889.1
8,430,629 B2 * 4/2013 Turi ..... F01D 9/044 415/189
8,534,965 B2 * 9/2013 Holmes ..... F04D 29/644 408/67
8,678,752 B2 * 3/2014 Delvaux ..... F01D 5/16 415/119
9,334,756 B2 * 5/2016 Ring ..... F01D 9/042
2003/0113204 A1 * 6/2003 Wolf ..... F01D 17/162 415/165
2006/0198726 A1 * 9/2006 Schirle ..... F04D 29/164 415/119
2007/0079506 A1 * 4/2007 Gautreau ..... F04D 29/667 29/888.021
2014/0248140 A1 * 9/2014 Jacques ..... F01D 5/3038 415/183
2016/0115800 A1 * 4/2016 Lyders ..... F01D 25/28 415/208.1
2016/0130960 A1 * 5/2016 Cortequisse ..... F01D 5/02 415/173.4
2016/0230574 A1 * 8/2016 Simonds ..... F01D 25/246

* cited by examiner

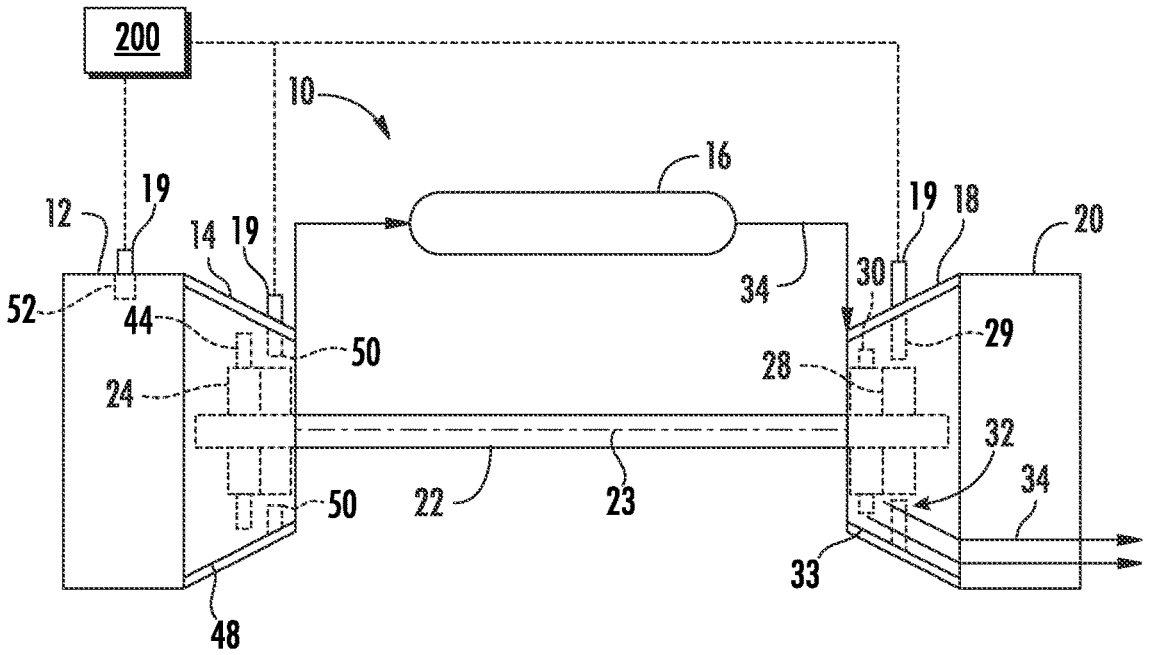
FIG. 1
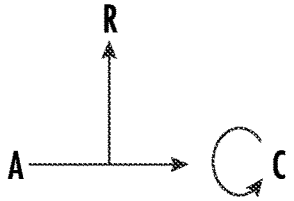

SPLIT-LINE STATOR VANE ASSEMBLY

CROSS-REFERENCE TO RELATED APPLICATIONS

This application claims the benefit of priority to Indian Patent Application No. 202111023487, filed on May 26, 2021, the disclosure of which is incorporated by reference herein in its entirety.

FIELD

The present disclosure relates generally to an improved a split-line stator vane assembly. In particular, the present disclosure relates to a compressor section of a turbomachine having an improved split-line stator vane assembly.

BACKGROUND

Turbomachines (such as a land-based power generating gas turbine) are utilized in a variety of industries and applications for energy transfer purposes. For example, a gas turbine engine generally includes a compressor section, a combustion section, a turbine section, and an exhaust section. The compressor section progressively increases the pressure of a working fluid entering the gas turbine engine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The combustion gases then exit the gas turbine via the exhaust section.

Generally, the compressor section includes a compressor casing, a plurality of stator vanes mounted to the compressor casing, and a plurality of rotor blades mounted to a rotor of the turbomachine. The compressor casing is a stationary component that includes an upper portion and a lower portion, which are connected to one another to surround the plurality of rotor blades. Where the upper portion and the lower portion of the compressor casing meet and are joined is typically referred to as a split-line of the compressor section. Traditionally, stator vanes mounted to the compressor casing near the split-line experience higher stresses and are more difficult to assemble and disassemble.

Accordingly, an improved compressor section having a split-line stator vane assembly is desired in the art. In particular, an improved split-line stator vane assembly, that reduces operational stresses, increases hardware life, and simplifies installation, is desired.

BRIEF DESCRIPTION

Aspects and advantages of the compressor sections and turbomachines in accordance with the present disclosure will be set forth in part in the following description, or may be obvious from the description, or may be learned through practice of the technology.

In accordance with one embodiment, a compressor section is provided. The compressor section includes a compressor casing that has an upper casing portion coupled to a lower casing portion such that a split-line is defined between the upper casing portion and the lower casing portion. A plurality of stator vanes circumferentially arranged in a stage of the compressor casing. The plurality of stator vanes comprising a split-line stator vane assembly mounted in the compressor casing at the split-line. The split-line stator vane assembly includes a first split-line stator vane that has a first shank with a first platform portion and a first mounting portion extends radially outward of the first platform portion and mounted to one of the upper casing portion or the lower casing portion of the compressor casing. A first airfoil extends radially inward of the platform portion. The first shank includes a protrusion that extends circumferentially beyond the split-line. A second split-line stator vane having second shank with a second platform portion and a second mounting portion extends radially outward of the second platform portion and mounted to the other of the upper casing portion or the lower casing portion of the compressor casing. A second airfoil extends radially inward of the second platform portion. The second shank includes a recess that extends circumferentially away from the split-line.

In accordance with another embodiment, a turbomachine is provided. The turbomachine includes a combustor section, a turbine section, and a compressor section. The compressor section includes a compressor casing that has an upper casing portion coupled to a lower casing portion such that a split-line is defined between the upper casing portion and the lower casing portion. A plurality of stator vanes circumferentially arranged in a stage of the compressor casing. The plurality of stator vanes comprising a split-line stator vane assembly mounted in the compressor casing at the split-line. The split-line stator vane assembly includes a first split-line stator vane that has a first shank with a first platform portion and a first mounting portion extends radially outward of the first platform portion and mounted to one of the upper casing portion or the lower casing portion of the compressor casing. A first airfoil extends radially inward of the platform portion. The first shank includes a protrusion that extends circumferentially beyond the split-line. A second split-line stator vane having second shank with a second platform portion and a second mounting portion extends radially outward of the second platform portion and mounted to the other of the upper casing portion or the lower casing portion of the compressor casing. A second airfoil extends radially inward of the second platform portion. The second shank includes a recess that extends circumferentially away from the split-line.

These and other features, aspects and advantages of the present compressor sections and turbomachines will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present compressor sections and turbomachines, including the best mode of making and using the present systems and methods, directed to one of ordinary skill in the art, is set forth in the specification, which makes reference to the appended figures, in which:

FIG. 1 is a schematic illustration of a turbomachine in accordance with embodiments of the present disclosure;

DETAILED DESCRIPTION

Figure 2:
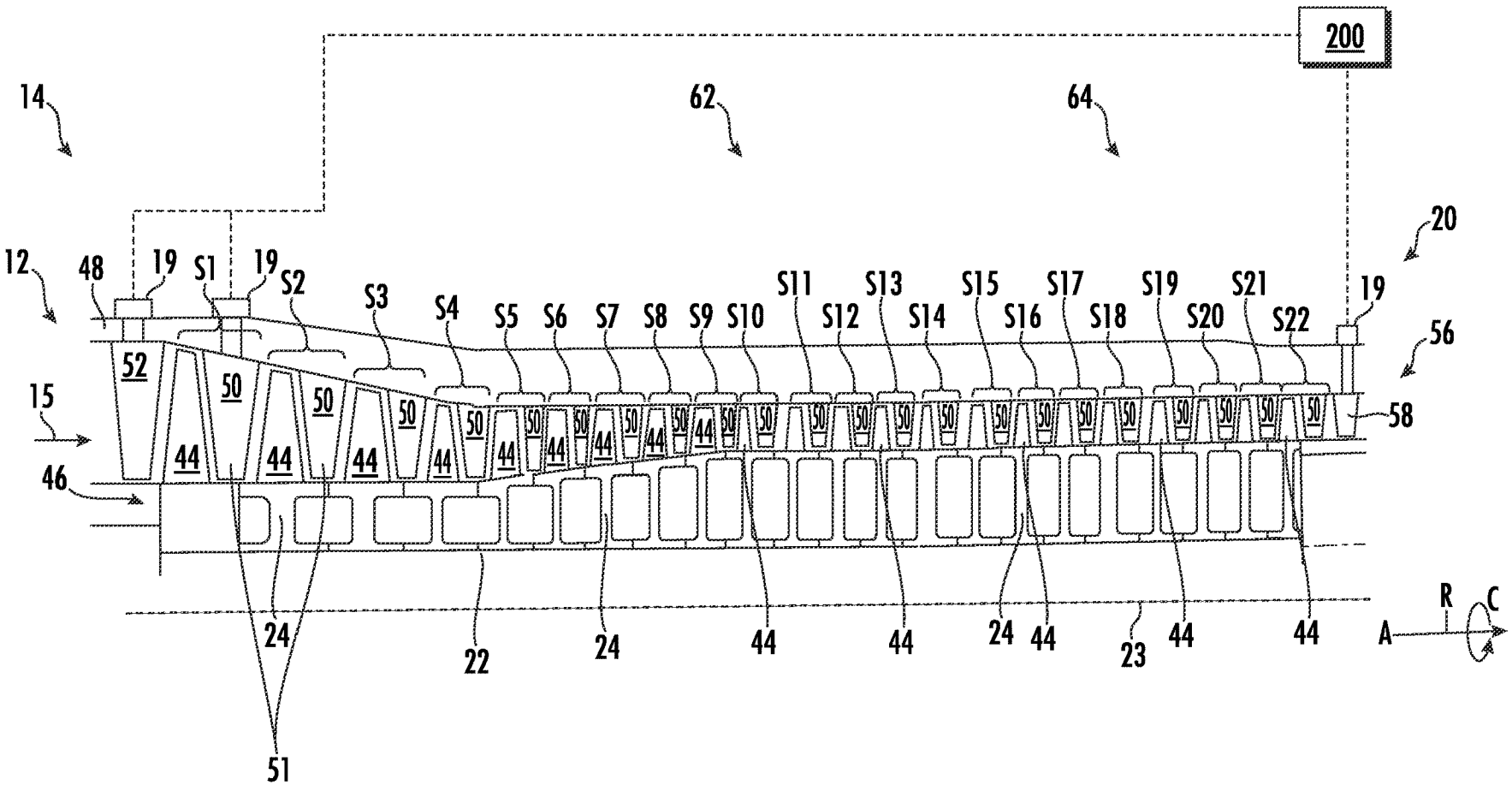
FIG. 2 illustrates a cross-sectional side view of a compressor section in accordance with embodiments of the present disclosure.

Reference now will be made in detail to embodiments of the present compressor sections and turbomachines, one or more examples of which are illustrated in the drawings. Each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components.

The term "fluid" may be a gas or a liquid. The term "fluid communication" means that a fluid is capable of making the connection between the areas specified.

The singular forms "a", "an", and "the" include plural references unless the context clearly dictates otherwise.

As used herein, the terms "upstream" (or "forward") and "downstream" (or "aft") refer to the relative direction with respect to fluid flow in a fluid pathway. For example, "upstream" refers to the direction from which the fluid flows, and "downstream" refers to the direction to which the fluid flows. However, the terms "upstream" and "downstream" as used herein may also refer to a flow of electricity. The term "radially" refers to the relative direction that is substantially perpendicular to an axial centerline of a particular component, the term "axially" refers to the relative direction that is substantially parallel and/or coaxially aligned to an axial centerline of a particular component and the term "circumferentially" refers to the relative direction that extends around the axial centerline of a particular component.

Terms of approximation, such as "about," "approximately," "generally," and "substantially," are not to be limited to the precise value specified. In at least some instances, the approximating language may correspond to the precision of an instrument for measuring the value, or the precision of the methods or machines for constructing or manufacturing the components and/or systems. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values and/or endpoints defining range(s) of values. When used in the context of an angle or direction, such terms include within ten degrees greater or less than the stated angle or direction. For example, "generally vertical" includes directions within ten degrees of vertical in any direction, e.g., clockwise or counter-clockwise.

The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive- or and not to an exclusive- or. For example, a condition A or B is satisfied by any one of the following: A is true (or present) and B is false (or not present), A is false (or not present) and B is true (or present), and both A and B are true (or present).

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

Referring now to the drawings, FIG. 1 illustrates a schematic diagram of one embodiment of a turbomachine, which in the illustrated embodiment is a gas turbine 10. Although an industrial or land-based gas turbine is shown and described herein, the present disclosure is not limited to a land-based and/or industrial gas turbine unless otherwise specified in the claims. For example, the invention as described herein may be used in any type of turbomachine including but not limited to a steam turbine, an aircraft gas turbine, or a marine gas turbine.

As shown, gas turbine 10 generally includes an inlet section 12, a compressor section 14 disposed downstream of the inlet section 12, a plurality of combustors (not shown) within a combustor section 16 disposed downstream of the compressor section 14, a turbine section 18 disposed downstream of the combustor section 16, and an exhaust section 20 disposed downstream of the turbine section 18. Additionally, the gas turbine 10 may include one or more shafts 22 coupled between the compressor section 14 and the turbine section 18.

The compressor section 14 may generally include a plurality of rotor disks 24 (one of which is shown) and a plurality of rotor blades 26 extending radially outwardly from and connected to each rotor disk 24. Each rotor disk 24 in turn may be coupled to or form a portion of the shaft 22 that extends through the compressor section 14.

The turbine section 18 may generally include a plurality of rotor disks 28 (one of which is shown) and a plurality of rotor blades 30 extending radially outwardly from and being interconnected to each rotor disk 28. Each rotor disk 28 in turn may be coupled to or form a portion of the shaft 22 that extends through the turbine section 18. The turbine section 18 further includes an outer casing 31 that circumferentially surrounds the portion of the shaft 22 and the rotor blades 30, thereby at least partially defining a hot gas path 32 through the turbine section 18.

During operation, a working fluid such as air flows through the inlet section 12 and into the compressor section 14 where the air is progressively compressed, thus providing pressurized air to the combustors of the combustor section 16. The pressurized air is mixed with fuel and burned within each combustor to produce combustion gases 34. The combustion gases 34 flow through the hot gas path 32 from the combustor section 16 into the turbine section 18, wherein energy (kinetic and/or thermal) is transferred from the combustion gases 34 to the rotor blades 30, causing the shaft 22 to rotate. The mechanical rotational energy may then be used to power the compressor section 14 and/or to generate electricity. The combustion gases 34 exiting the turbine section 18 may then be exhausted from the gas turbine 10 via the exhaust section 20.

FIG. 2 illustrates a cross-sectional side view of an embodiment of the compressor section 14 of the gas turbine 10 of FIG. 1, which is shown as a multi-stage axial compressor section 14, in accordance with embodiments of the present disclosure. As shown in FIGS. 1 and 2, the gas turbine 10 may define a cylindrical coordinate system. The cylindrical coordinate system may define an axial direction A (e.g. downstream direction) substantially parallel to and/or along an axial centerline 23 of the gas turbine 10, a radial direction R perpendicular to the axial centerline or rotary axis 23, and a circumferential direction C extending around the axial centerline 23.

In operation, air 15 may enter the compressor section 14 in the axial direction A through the inlet section 12 and may be pressurized in the multi-stage axial compressor section 14. The compressed air may then be mixed with fuel for combustion within the combustor section 16 to drive the turbine section 18, which rotates the shaft 22 in the circumferential direction C and, thus, the multi-stage axial compressor section 14. The rotation of the shaft 22 also causes one or more rotor blades 44 (e.g., compressor rotor blades) within the multi-stage axial compressor section 14 to draw in and pressurize the air received by the inlet section 12.

The multi-stage axial compressor section 14 may include a rotor assembly 46 having a plurality of rotor disks 24. Rotor blades 44 may extend radially outward from the rotor disks 24. The entire rotor assembly 46 (e.g. rotor disks 24 and rotor blades 44) may rotate in the circumferential direction C during operation of the gas turbine 10. The rotor assembly 46 may be surrounded by a compressor casing 48. The compressor casing may be static or stationary, such that the rotor assembly 46 rotates relative to the compressor casing 48. Stator vanes 50 (e.g., variable stator vanes and/or fixed stator vanes) may extend radially inward from the compressor casing 48. As shown in FIG. 2, one or more stages of the stator vanes 50 may be variable stator vanes 51, such that an angle of the stator vane 50 may be selectively actuated (e.g. by a controller 200). For example, in the embodiments shown in FIG. 2, first two stages of the compressor section 14 may include variable stator vanes 51. In many embodiments, as shown, the rotor blades 44 and stator vanes 50 may be arranged in an alternating fashion, such that most of the rotor blades 44 are disposed between two stator vanes 50 in the axial direction A.

In some embodiments, the compressor casing 48 of the compressor section 14 or the inlet section 12 may have one or more sets of inlet guide vanes 52 (IGVs) (e.g., variable IGV stator vanes). The inlet guide vanes 52 may be mounted to the compressor casing 48, spaced apart from one another in the circumferential direction C, and may be operable to control the amount of air 15 that enters the compressor section 14. Additionally, an outlet 56 of the compressor section 14 may have a set of outlet guide vanes 58 (OGVs). The OGVs 58 may be mounted to the compressor casing 48, spaced apart from one another in the circumferential direction C, and may be operable to control the amount of air 15 that exits the compressor section 14.

In exemplary embodiments, as shown in FIG. 2, the variable stator vane 51, the IGVs 52, and the OGVs may each be configured to vary its vane angle relative to the gas flow (e.g. air flow) by rotating the vane 51, 52, 58 about an axis of rotation (e.g., radially oriented vane shaft). However, each variable stator vane 51 (including the IGVs 52 and the OGVs 58) may be otherwise stationary relative to the rotor blades 44. In certain embodiments, the variable stator vanes 51, the IGVs 52, and the OGVs 58 may be coupled to an actuator 19 (e.g., electric drive, pneumatic drive, or hydraulic drive). The actuators 19 may be in operable communication (e.g. electrical communication) with a controller 200. The controller may be operable to selectively vary the vane angle. In other embodiments, all of the stator vanes 50 may be fixed, such that the stator vanes 50 are configured to remain in a fixed angular position (e.g. the vane angle does not vary).

The compressor section 14 may include a plurality of rows or stages arranged in a serial flow order, such as between 2 to 30, 2 to 25, 2 to 20, 2 to 14, or 2 to 10 rows or stages, or any specific number or range therebetween. Each stage may include a plurality of rotor blades 44 circumferentially spaced about the axial centerline 23 and a plurality of stator vanes 50 circumferentially spaced about the axial centerline 23. In each stage, the multi-stage axial compressor section 14 may include 2 to 1000, 5 to 500, or 10 to 100 of circumferentially arranged rotor blades 44, and 2 to 1000, 5 to 500, or 10 to 100 of circumferentially arranged stator vanes 50. In particular, the illustrated embodiment of the multi-stage axial compressor section 14 includes 22 stages (e.g. S1-S22).

It may be appreciated that each stage has a set of rotor blades 44 disposed at a first axial position and a set of stator vanes 50 disposed at a second axial position along the length of the compressor section 14. In other words, each stage has the rotor blades 44 and stator vanes 50 axially offset from one another, such that the compressor section 14 has an alternating arrangement of rotor blades 44 and stator vanes 50 one set after another along the length of the compressor section 14. Each set of rotor blades 44 extends (e.g., in a spaced arrangement) in the circumferential direction C about the shaft 22, and each set of stator vanes 50 extends (e.g., in a spaced arrangement) in the circumferential direction C within the compressor casing 48.

While the compressor section 14 may include greater or fewer stages than is illustrated, FIG. 2 illustrates an embodiment of the compressor section 14 having twenty two stages arranged in a serial flow order and identified as follows: first stage S1, second stage S2, third stage S3, fourth stage S4, fifth stage S5, sixth stage S6, seventh stage S7, eighth stage S8, ninth stage S9, tenth stage S10, eleventh stage S11, twelfth stage S12, thirteenth stage S13, and fourteenth stage S14, fifteenth stage S15, sixteenth stage S16, seventeenth stage S17, eighteenth stage S18, nineteenth stage S19, twentieth stage S20, twenty-first stage S21, and twenty-second stage S22. In certain embodiments, each stage may include rotor blades 44 and stator vanes 50 (e.g., fixed stator vanes 50 and/or variable stator vanes 51). As used herein, a rotor blade 44 disposed within one of the sections S1-S22 of the compressor section 14 may be referred to by whichever stage it is disposed within, e.g. "a first stage compressor rotor blade," "a second stage compressor rotor blade," "a third stage compressor rotor blade," etc.

In use, the rotor blades 44 may rotate circumferentially about the compressor casing 48 and the stator vanes 50. Rotation of the rotor blades 44 may result in air entering the inlet section 12. The air is then subsequently compressed as it traverses the various stages (e.g., first stage S1 to twenty-second stage S22) of the compressor section 14 and moves in the axial direction 38 downstream of the multi-stage axial compressor section 14. The compressed air may then exit through the outlet 56 of the multi-stage axial compressor section 14. As discussed above, the outlet 56 may have a set of outlet guide vanes 58 (OGVs). The compressed air that exits the compressor section 14 may be mixed with fuel, directed to the combustor section 16, directed to the turbine section 18, or elsewhere in the gas turbine 10.

Figure 3:
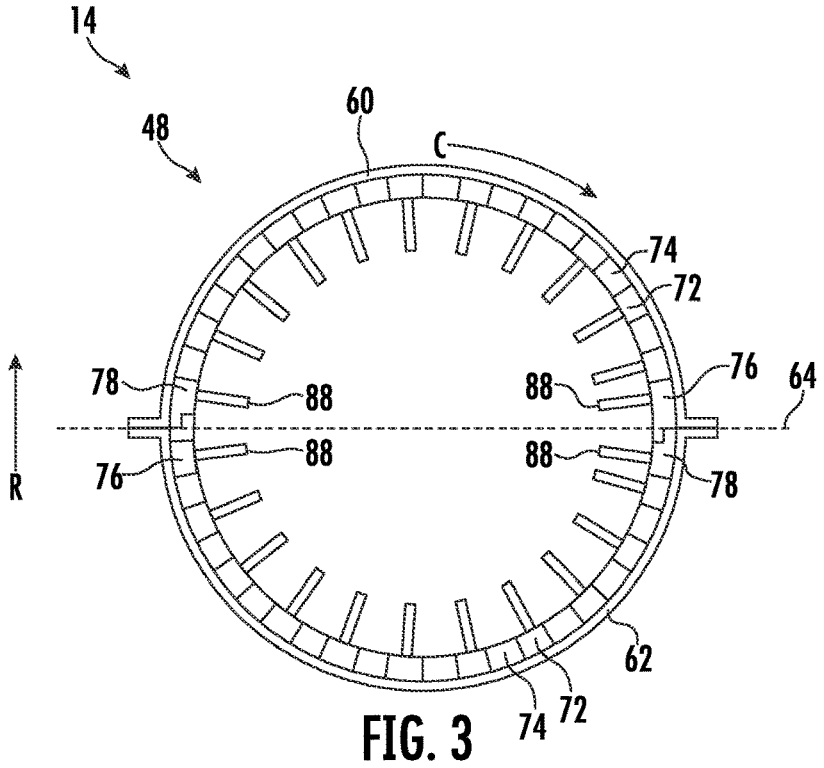
FIG. 3 illustrates a cross-sectional view of a compressor section from along an axial centerline of the compressor section, in accordance with embodiments of the present disclosure.
Figure 4:
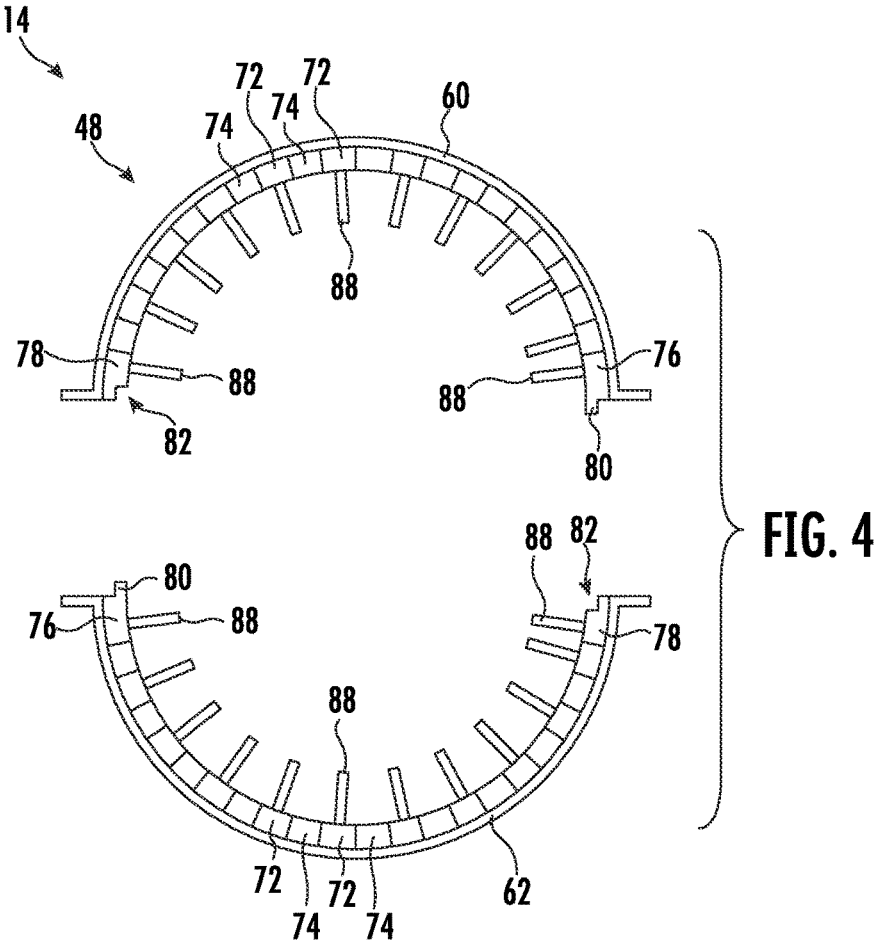
FIG. 4 illustrates an exploded cross-sectional view of a compressor section from along an axial centerline of the compressor section in accordance with embodiments of the present disclosure.

FIGS. 3 and 4 each illustrate a schematic cross-sectional view of a compressor section 14, in accordance with embodiments of the present disclosure. Particularly, FIGS. 3 and 4 each illustrate a single stage (such as any one of S1-S22 of the compressor section 14) of stator vanes 50 circumferentially arranged in, and mounted in, a compressor casing 48 of the compressor section 14. As shown, in exemplary embodiments, the compressor casing 48 may include an upper casing portion 60 and a lower casing portion 62, such that a first half (e.g., about 50%) of the stator vanes 50 are mounted in the upper casing portion 60 and a second half (e.g., about 50%) of the stator vanes 50 are mounted in the lower casing portion 62. During assembly of the compressor section 14, the first half of the stator vanes 50 may be installed in the upper casing portion 60, and the second half of the stator vanes 50 may be installed in the lower casing portion 62. Subsequently, the upper casing portion 60 may be coupled to the lower casing portion 62.

For example, the upper casing portion 60 and the lower casing portion 62 may couple to one another such that a split-line 64 is defined between the upper casing portion 60 and the lower casing portion 62. The split-line 64 may be a horizontal line defined at the junction (e.g., the contact point or plane) of the upper casing portion 60 and the lower casing portion 62. In many embodiments, the split-line 64 may extend along the radial direction R through a center point of the compressor section 14.

In exemplary embodiments, the plurality of stator vanes 50 may include a split-line stator vane assembly 70 mounted in the compressor casing 48 at the split-line 64. Particularly, because the upper and lower casing portions 60, 62 may connect to one another on two ends, the plurality of stator vanes 50 may include two split-line stator vane assemblies 70 (e.g., each located at the split-line 64 on either side of the compressor casing 48). In various embodiments, the split-line stator vane assembly 70 may be disposed in any stage of the compressor section 14 (e.g., S1-S22). In some embodiments, the split-line stator vane assembly 70 may be disposed in one or more of stages three (S3) through sixteen (S16). However, in exemplary embodiments, the split-line stator vane assembly 70 may be disposed in one or more of stages eleven (S11) through sixteen (S16).

As shown schematically in FIGS. 3 and 4, the stator vane assembly 70 may include a first split-line stator vane 76 mounted in one of the upper casing portion 60 or the lower casing portion 62. Additionally, the stator vane assembly 70 may further include a second split-line stator vane 78 mounted in the other of the upper casing portion 60 or the lower casing portion 62, such that the first split-line stator vane 76 and the second split-line stator vane 78 are disposed adjacent to one another and at least partially contact the split-line 64 of the compressor section 14. Particularly, the first split-line stator vane 76 may include a protrusion 80 that intersects (and extends across) the split-line 64 of the compressor section 14, and the second split-line stator vane 78 may define a recess 82 that that is complementary to the protrusion (such that the recess 82 receives the protrusion 80). For example, the recess 82 may correspond in shape and size to the protrusion 80, such that they may flushly contact one another when assembled (FIG. 4). In this way, the first split-line stator vane 76 may be mounted in one of the upper casing portion 60 or the lower casing portion 62, and the protrusion 80 may extend across the split-line 64 into the recess 82 disposed in the second split-line stator vane 78 mounted in the other of the upper casing portion 60 or the lower casing portion 62.

Additionally, the plurality of stator vanes 50 may further include a plurality of main-body stator vanes 72 and a plurality of spacers 74 mounted in the compressor casing 48. For example, the main-body stator vanes 72 and the spacers 74 may be mounted in an alternating arrangement in both the upper casing portion 60 and the lower casing portion 62 between the split-line stator vane assemblies 70. In this way, all of the main-body stator vanes 72 and spacers 74 in the upper casing portion 60 may be disposed circumferentially between a first split-line stator vane assembly 70 and a second split-line stator vane assembly 70, such that none of the main-body stator vanes 72 or spacers 74 in the upper casing portion 60 contact or intersect with the split-line 64 of the compressor section 14. Similarly, all of the main-body stator vanes 72 and spacers 74 in the lower casing portion 62 may be disposed circumferentially between a first split-line stator vane assembly 70 and a second split-line stator vane assembly 70, such that none of the main-body stator vanes 72 or spacers 74 in the lower casing portion 62 contact or intersect with the split-line 64 of the compressor section 14.

In many embodiments, the main-body stator vane 72 may include a platform portion and a mounting body. The platform portion of the main-body stator vane 72 may define a main circumferential width (e.g., measured between the pressure-side slash face and the suction-side slash face). Similarly, the first platform portion 84 of the first split-line stator vane 76 may define a first circumferential width, and the second platform portion 94 of the second split-line stator vane 78 may define a second circumferential width. The main circumferential width of the main-body stator vane 72 may be smaller than both the first circumferential width of the first split-line stator vane 76 and the second circumferential width of the second split-line stator vane 78.

Figure 5:
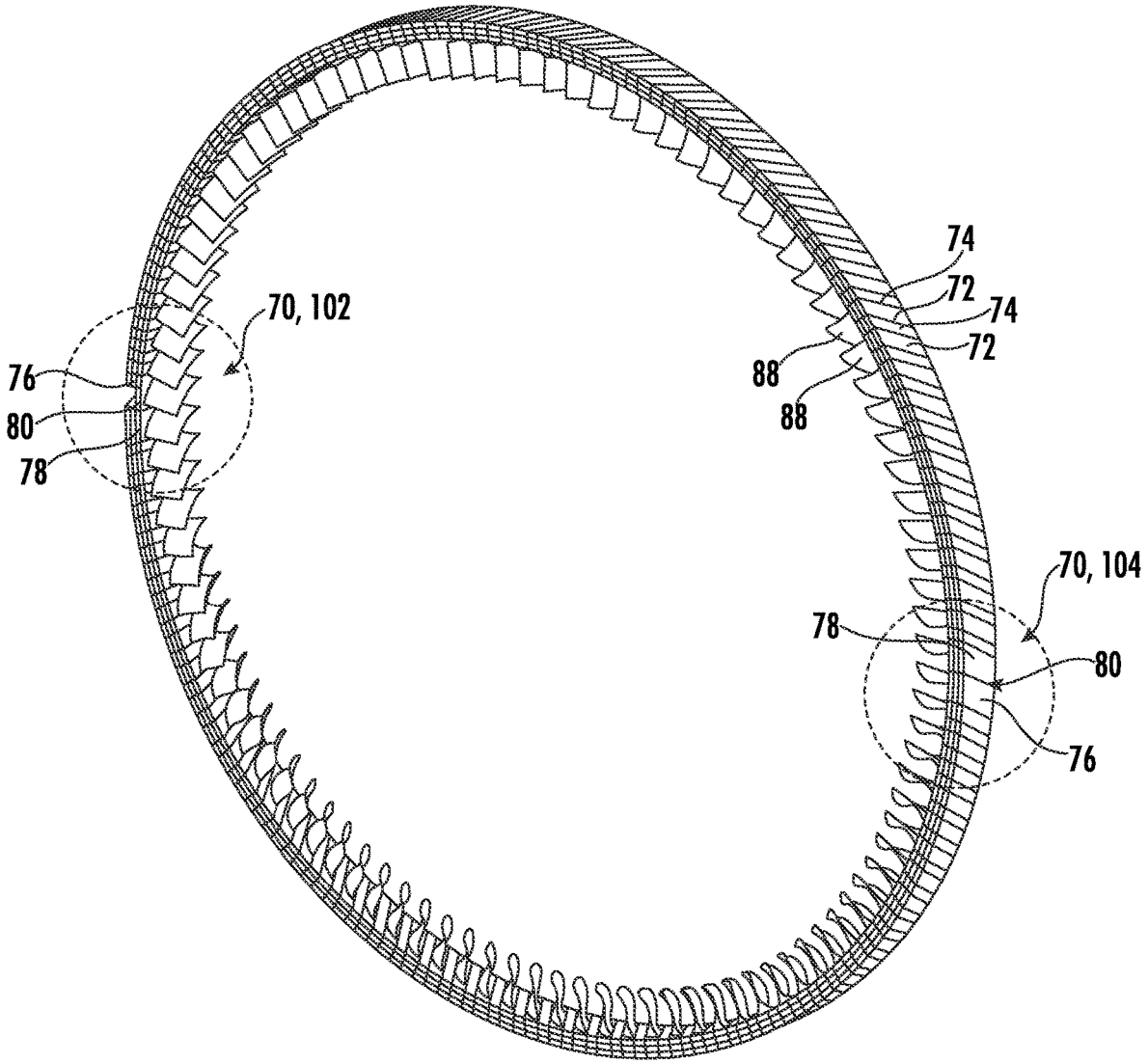
FIG. 5 illustrates a perspective view of a single stage of stator vanes in accordance with embodiments of the present disclosure.

FIG. 5 illustrates a perspective view of a single stage of stator vanes 50 isolated from the compressor casing 48. As shown, the split-line stator vane assemblies 70 are circled with a dashed line. For example, the split-line stator vane assemblies 70 may include a first split-line stator vane assembly 103 at a first end (e.g., a first end of the compressor casing 48 at the split-line 64), and a second split-line stator vane assembly 105 at a second end (e.g., a second end of the compressor casing 48 at the split-line 64). In this way, as shown, the first split-line stator vane assembly 103 may be diametrically opposed to the second split-line stator vane assembly 105. Additionally, as shown in FIGS. 4 and 5, each of the main-body stator vanes 72 may circumferentially neighbor one of two spacers 74 of the plurality of spacers 74 or one spacer 74 of the plurality of spacers 74 and the split-line stator vane assembly 70. For example, each main-body stator vane 72 may be positioned between two spacers 74. Additionally or alternatively, near the split-line 64, one or more main-body stator vanes 72 may be disposed between one spacer 74 and a split-line stator vane (such as the first split-line stator vane 76 or the second split-line stator vane 78).

Figure 6:
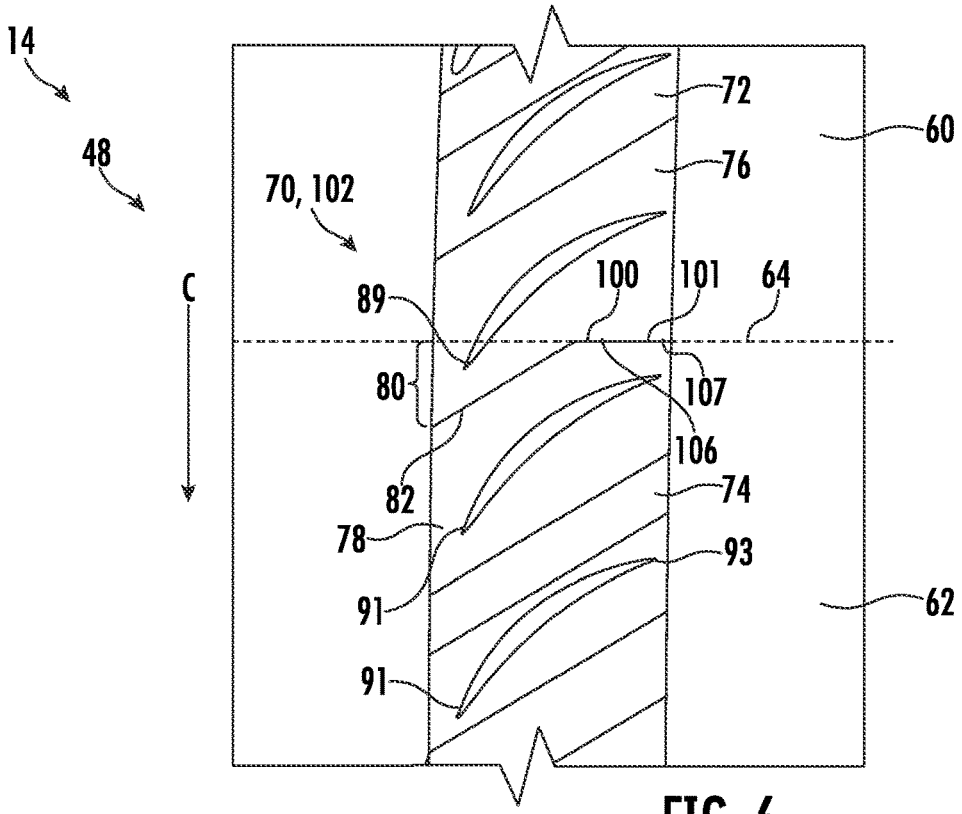
FIG. 6 illustrates an enlarged plan view of a first split-line assembly in accordance with embodiments of the present disclosure.
Figure 7:
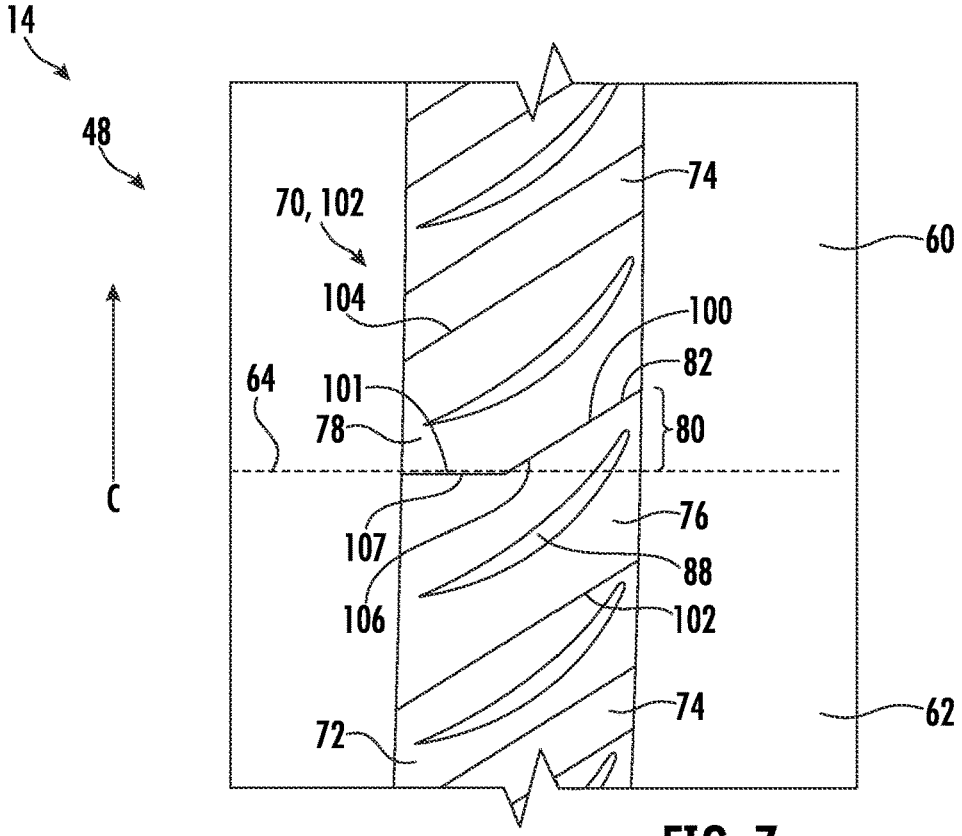
FIG. 7 illustrates an enlarged plan view of a second split-line assembly in accordance with embodiments of the present disclosure.

FIG. 6 illustrates an enlarged plan view of the first split-line assembly 103, and FIG. 7 illustrates an enlarged plan view of the second split-line assembly 105, in accordance with embodiments of the present disclosure. As shown, the first split-line stator vane 76 and the second split-line stator vane 78 may directly neighbor one another when arranged in the compressor casing 48, such that the first split-line stator vane 76 and the second split-line stator vane 78 are in direct contact with one another (e.g., no spacers or intermediate components positioned between the split-line stator vanes 76 and 78). Additionally, the first split-line stator vane 76 and the second split-line stator vane 78 may each at least partially contact (and/or extend across) the split-line 64. In exemplary embodiments, as shown in FIGS. 6 and 7, the protrusion 80 may extend circumferentially beyond the split-line 64 (e.g., beyond the split-line 64 and into the recess 82 which is correspondingly shaped). Likewise, as shown, the recess 82 may extend circumferentially away from the split-line 64, in order to define a space for the protrusion 80 to extend.

Figure 8:
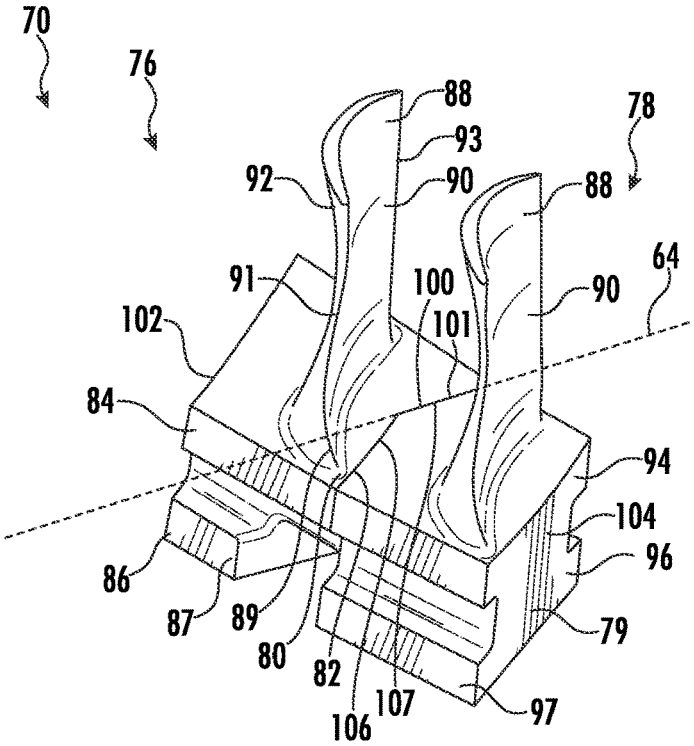
FIG. 8 illustrates a perspective view of a split-line stator vane assembly in accordance with embodiments of the present disclosure.
Figure 9:
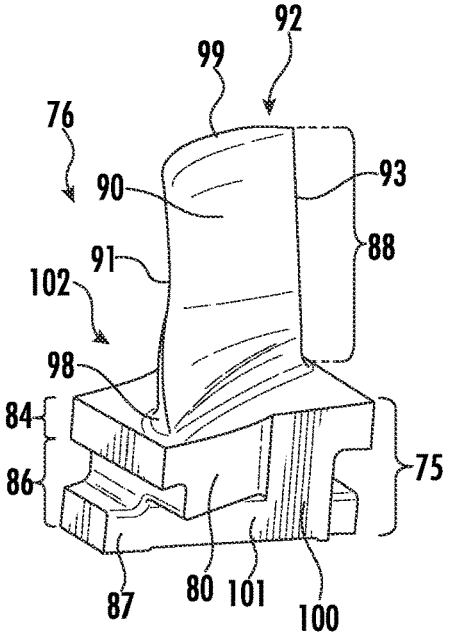
FIG. 9 illustrates a perspective view of a first split-line stator vane of the split-line stator vane assembly shown in FIG. 8 in accordance with embodiments of the present disclosure.
Figure 10:
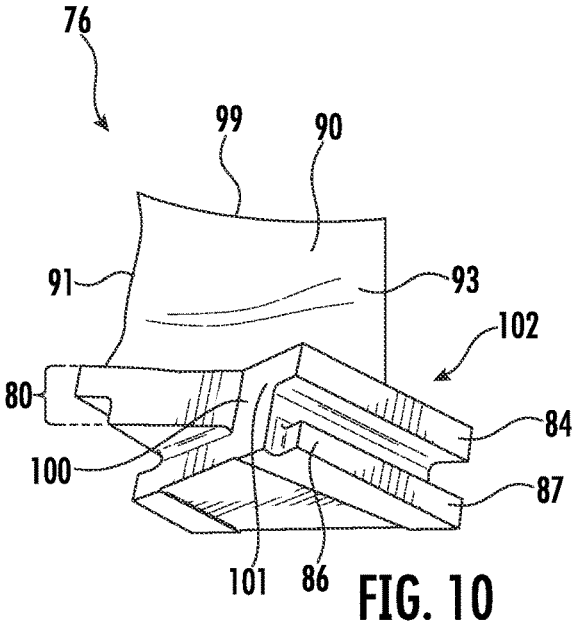
FIG. 10 illustrates a perspective view of a first split-line stator vane of the split-line stator vane assembly shown in FIG. 8 in accordance with embodiments of the present disclosure.
Figure 11:
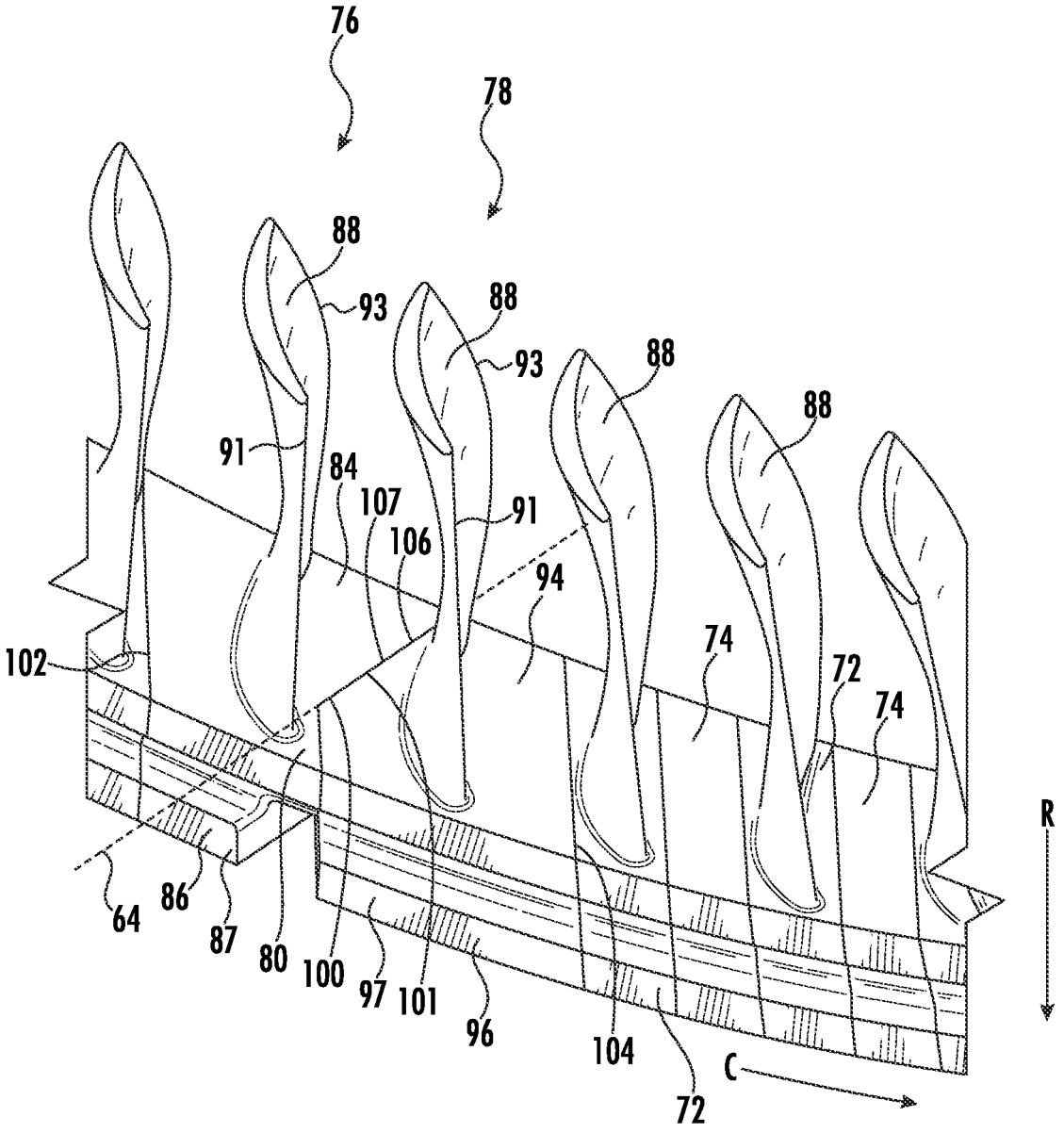
FIG. 11 illustrates an enlarged plan view of a split-line assembly in accordance with embodiments of the present disclosure.

FIG. 8 illustrates a perspective view of a split-line stator vane assembly 70, and FIGS. 9 and 10 each illustrate different perspective views of a first split-line stator vane 76 of the split-line stator vane assembly 70, in accordance with embodiments of the present disclosure. As shown, the first split-line stator vane 76 may include a first shank 75 having a first platform portion 84 and a first mounting portion 86. In exemplary embodiments, the protrusion 80 may be defined by the shank 75 (i.e., collectively defined by the first platform portion 84 and the first mounting portion 86). Additionally, the first mounting portion 86 may extending radially outward of the first platform portion 84. The first mounting portion 86 may be mounted to one of the upper casing portion 60 or the lower casing portion 62 of the compressor casing 48. In many embodiments, the first mounting portion 86 may include a protrusion 87 a that is slidably received by a corresponding recess defined in the compressor casing 48. For example, the first mounting portion 86 may be a dovetail or other suitable mounting construction that is slidably received by a correspondingly-shaped slot defined in the compressor casing 48.

Likewise, as shown, the second split-line stator vane 78 may include a second shank 79 having a second platform portion 94 and a second mounting portion 96. In exemplary embodiments, the recess 82 may be defined by the second shank 79 (i.e., collectively defined by the second platform portion 94 and the second mounting portion 96). Additionally, a second mounting portion 96 may extending radially outward of the second platform portion 94. The second mounting portion 96 may be mounted to one of the upper casing portion 60 or the lower casing portion 62 of the compressor casing 48. Particularly, the second mounting portion 96 is mounted to the other of the upper casing portion 60 or the lower casing portion 62 that the first mounting portion 86 is mounted on. For example, if the first split-line stator vane 76 is attached to the upper casing portion 60, then the second split-line stator vane 78 would be mounted to the lower casing portion 62 (and vice versa). In many embodiments, the second mounting portion 96 may include a protrusion 97 that may be slidably received by a corresponding recess defined in the compressor casing 48. For example, the second mounting portion 96 may be a dovetail or other suitable mounting construction that is slidably received by a correspondingly-shaped slot defined in the compressor casing 48.

In many embodiments, each of the stator vanes 50 described herein, including the first split-line stator vane 76, the second split-line stator vane 78, and the main-body stator vanes 72, may include an airfoil 88 that extends radially inwardly from the respective platform portion of the respective stator vane when the stator vane is mounted in the casing 48. Each airfoil 88 may include a pressure-side surface 90 and an opposing suction-side surface 92. The pressure-side surface 90 and the suction-side surface 92 meet or intersect at a leading edge 91 and a trailing edge 93 of the airfoil 88. The leading edge 91 and the trailing edge 93 may be spaced apart from one another and define the terminal ends of the airfoil 88.

The pressure-side surface 90 generally defines an aerodynamic, concave external surface of the airfoil 88. Similarly, the suction-side surface 92 may generally define an aerodynamic, convex external surface of the airfoil 88. The leading edge 91 of airfoil 88 may be the first portion of the airfoil 88 to engage, i.e., be exposed to, the compressed air within the compressor section 14. Compressed air may be guided along the aerodynamic contour of airfoil 88 from the leading edge 91 to the trailing edge 93.

In many embodiments, each airfoil 88 may include a root or first end 98, which intersects with and extends radially outwardly from the respective platform portion of the stator vane. Each airfoil 88 terminates radially at a second end or tip 99 of the airfoil 88. The root 98 of the airfoil 88 may be defined at an intersection between the airfoil 88 and the platform portion of the stator vane.

In exemplary embodiments, as shown best in FIGS. 8 through 10, the first shank 75 may define a first pressure-side slash face 100 and a first suction-side slash face 102. The first pressure-side slash face 100 and the first suction-side slash face 102 may be circumferentially spaced apart from one another and disposed on opposite sides of the airfoil 88. Similarly, the second shank 79 may define a second pressure-side slash face 104 and a second suction-side slash face 106. The second pressure-side slash face 104 and the second suction-side slash face 106 may be circumferentially spaced apart from one another and disposed on opposite sides of the airfoil 88.

In many embodiments, as shown, the first pressure-side slash face 100 contacts the second suction-side slash face 106. For example, the first pressure-side slash face 100 of the first split-line stator vane 76 and the second suction-side slash face 106 of the second split-line stator vane 78 may be entirely in contact with one another (e.g., both faces 100 and 106 may be contoured to correspond with one another such that they are in flush contact). Particularly, in exemplary embodiments, the protrusion 80 may be defined on the first pressure-side slash face 100, and the recess 82 may be defined on the second suction-side slash face 106. In this way, the protrusion 80 of the first split-line stator vane 76 may be entirely in contact with the recess 82 of the second split-line stator vane 78.

In many embodiments, the first suction-side slash face 102 and the second pressure-side slash face 104 are planar surfaces (e.g., entirely planar surfaces). For example, as shown, the first suction-side slash face 102 and the second pressure-side slash face 104 may be substantially flat surfaces (e.g., not including any curvatures, protrusions, or recesses). This allows the first suction-side slash face 102 and the second pressure-side slash face 104 to be in flush contact with one of a spacer 74 or a main-body stator vane 72 when installed in the casing 48 of the compressor section 14.

Additionally, in many embodiments, the first pressure-side slash face 100 includes a first planar portion 101, and the second suction-side slash face 106 includes a second planar portion 107. The first planar portion 101 and the second planar portion 107 may be generally parallel to one another and generally parallel to the first suction-side slash face 102 and the second pressure-side slash face 104. For example, the first planar portion 101 and the second planar portion 107 may be aligned with the split-line 64. In exemplary embodiments, as shown best in FIGS. 8 through 10, a portion 89 of the airfoil 88 belonging to the first split-line stator vane 76 is coupled to the protrusion 80 of the first split-line stator vane 76 such that the portion 89 of the first airfoil extends circumferentially beyond the split-line 64. For example, the portion 89 may include the leading edge 91 of the airfoil 88.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

Further aspects of the invention are provided by the subject matter of the following clauses:

A compressor section of a turbomachine comprising a compressor casing having an upper casing portion coupled to a lower casing portion such that a split-line is defined between the upper casing portion and the lower casing portion; and a plurality of stator vanes circumferentially arranged in a stage of the compressor casing, the plurality of stator vanes comprising a split-line stator vane assembly mounted in the compressor casing at the split-line, the split-line stator vane assembly comprising a first split-line stator vane having a first shank with a first platform portion and a first mounting portion extending radially outward of the first platform portion and mounted to one of the upper casing portion or the lower casing portion of the compressor casing, and a first airfoil extending radially inward of the platform portion, wherein the first shank includes a protrusion that extends circumferentially beyond the split-line; and a second split-line stator vane having a second shank with a second platform portion and a second mounting portion extending radially outward of the second platform portion and mounted to the other of the upper casing portion or the lower casing portion of the compressor casing, and a second airfoil extending radially inward of the second platform portion, wherein the second shank includes a recess complementary to the protrusion that extends circumferentially away from the split-line.

The compressor section of one or more of these clauses, wherein the first shank defines a first pressure-side slash face and a first suction-side slash face, wherein the second shank defines a second pressure-side slash face and a second suction-side slash face, and wherein the first pressure-side slash face of the first shank contacts the second suction-side slash face of the second shank.

The compressor section of one or more of these clauses, wherein the protrusion is defined on the first pressure-side slash face, and wherein the recess is defined on the second suction-side slash face.

The compressor of one or more of these clauses, wherein the first suction-side slash face and the second pressure-side slash face are planar surfaces.

The compressor section of one or more of these clauses, wherein the first pressure-side slash face includes a first planar portion, and wherein the second suction-side slash face includes a second planar portion.

The compressor section of one or more of these clauses, wherein the first planar portion and the second planar portion are aligned with the split-line.

The compressor of one or more of these clauses, wherein a portion of the first airfoil is coupled to the protrusion of the first platform portion of the first split-line stator vane such that the portion of the first airfoil extends circumferentially beyond the split-line.

The compressor of one or more of these clauses, wherein the plurality of stator vanes comprises a plurality of main-body stator vanes and a plurality of spacers mounted the compressor casing.

The compressor of one or more of these clauses, wherein each main-body stator vane of the plurality of main-body stator vanes is disposed circumferentially between one of two spacers of the plurality of spacers or one spacer of the plurality of spacers and the split-line stator vane assembly.

A split-line stator vane assembly configured to be mounted in a compressor casing at a split-line, the split-line stator vane assembly comprising a first split-line stator vane having a first shank with a first platform portion and a first mounting portion extending radially outward of the first platform portion and mounted to one of the upper casing portion or the lower casing portion of the compressor casing, and a first airfoil extending radially inward of the platform portion, wherein the first shank includes a protrusion that extends circumferentially beyond the split-line; and a second split-line stator vane having a second shank with a second platform portion and a second mounting portion extending radially outward of the second platform portion and mounted to the other of the upper casing portion or the lower casing portion of the compressor casing, and a second airfoil extending radially inward of the second platform portion, wherein the second shank includes a recess complementary to the protrusion that extends circumferentially away from the split-line.

The split-line stator vane assembly of one or more of these clauses, wherein the first shank defines a first pressure-side slash face and a first suction-side slash face, wherein the second shank defines a second pressure-side slash face and a second suction-side slash face, and wherein the first pressure-side slash face of the first shank contacts the second suction-side slash face of the second shank.

The split-line stator vane assembly of one or more of these clauses, wherein the protrusion is defined on the first pressure-side slash face, and wherein the recess is defined on the second suction-side slash face.

The split-line stator vane assembly of one or more of these clauses, wherein the first suction-side slash face and the second pressure-side slash face are planar surfaces.

The split-line stator vane assembly of one or more of these clauses, wherein the first pressure-side slash face includes a first planar portion, and wherein the second suction-side slash face includes a second planar portion.

The split-line stator vane assembly of one or more of these clauses, wherein the first planar portion and the second planar portion are aligned with the split-line.

The split-line stator vane assembly of one or more of these clauses, wherein a portion of the first airfoil is coupled to the protrusion of the first platform portion of the first split-line stator vane such that the portion of the first airfoil extends circumferentially beyond the split-line.

The split-line stator vane assembly of one or more of these clauses, wherein the plurality of stator vanes comprises a plurality of main-body stator vanes and a plurality of spacers mounted the compressor casing.

The split-line stator vane assembly of one or more of these clauses, wherein each main-body stator vane of the plurality of main-body stator vanes is disposed circumferentially between one of two spacers of the plurality of spacers or one spacer of the plurality of spacers and the split-line stator vane assembly.

A turbomachine, comprising a combustor section; a turbine section; and a compressor section comprising a compressor casing having an upper casing portion coupled to a lower casing portion such that a split-line is defined between the upper casing portion and the lower casing portion; and a plurality of stator vanes circumferentially arranged in a stage of the compressor casing, the plurality of stator vanes comprising a split-line stator vane assembly mounted in the compressor casing at the split-line, the split-line stator vane assembly comprising a first split-line stator vane having a first shank with a first platform portion and a first mounting portion extending radially outward of the first platform portion and mounted to one of the upper casing portion or the lower casing portion of the compressor casing, and a first airfoil extending radially inward of the platform portion, wherein the first shank includes a protrusion that extends circumferentially beyond the split-line; and a second split-line stator vane having a second shank with a second platform portion and a second mounting portion extending radially outward of the second platform portion and mounted to the other of the upper casing portion or the lower casing portion of the compressor casing, and a second airfoil extending radially inward of the second platform portion, wherein the second shank includes a recess complementary to the protrusion that extends circumferentially away from the split-line.

What is claimed is:

1. A compressor section of a turbomachine, the compressor section comprising:

a compressor casing having an upper casing portion coupled to a lower casing portion such that a split-line is defined between the upper casing portion and the lower casing portion; and a plurality of stator vanes circumferentially arranged in a stage of the compressor casing, the plurality of stator vanes comprising a split-line stator vane assembly mounted in the compressor casing at the split-line, the split-line stator vane assembly comprising:

a first split-line stator vane having a first shank with a first platform portion and a first mounting portion extending radially outward of the first platform portion and mounted to one of the upper casing portion or the lower casing portion of the compressor casing, and a first airfoil extending radially inward of the first platform portion and terminating at a first tip, the first tip being a first free end, wherein the first shank includes a protrusion that extends circumferentially beyond the split-line; and a second split-line stator vane having a second shank with a second platform portion and a second mounting portion extending radially outward of the second platform portion and mounted to the other of the upper casing portion or the lower casing portion of the compressor casing opposite the first split-line stator vane, and a second airfoil extending radially inward of the second platform portion and terminating at a second tip, the second tip being a second free end, wherein the second shank includes a recess that extends circumferentially away from the split-line, the recess being complementary to the protrusion, wherein a leading edge portion of the first airfoil is coupled to the protrusion of the first shank of the first split-line stator vane such that only the leading edge portion of the first airfoil extends circumferentially beyond the split-line.

2. The compressor section of claim 1, wherein the first shank defines a first pressure-side slash face and a first suction-side slash face, wherein the second shank defines a second pressure-side slash face and a second suction-side slash face, and wherein the first pressure-side slash face of the first shank contacts the second suction-side slash face of the second shank.

3. The compressor section of claim 2, wherein the protrusion is defined on the first pressure-side slash face, and wherein the recess is defined on the second suction-side slash face.

4. The compressor section of claim 3, wherein the first suction-side slash face and the second pressure-side slash face are planar surfaces.

5. The compressor section of claim 3, wherein the first pressure-side slash face includes a first planar portion, and wherein the second suction-side slash face includes a second planar portion.

6. The compressor section of claim 5, wherein the first planar portion and the second planar portion are aligned with the split-line, and wherein the protrusion extends circumferentially outwardly from the first planar portion beyond the split-line.

7. The compressor section of claim 1, wherein the plurality of stator vanes comprises a plurality of main-body stator vanes and a plurality of spacers mounted to the compressor casing.

8. The compressor section of claim 7, wherein each main-body stator vane of the plurality of main-body stator vanes is disposed circumferentially between one of:

two spacers of the plurality of spacers, or one spacer of the plurality of spacers and the split-line stator vane assembly.

9. A split-line stator vane assembly configured to be mounted in a compressor casing at a split-line, the split-line stator vane assembly comprising:

a first split-line stator vane having a first shank with a first platform portion and a first mounting portion extending radially outward of the first platform portion and mounted to one of an upper casing portion or a lower casing portion of the compressor casing, and a first airfoil extending radially inward of the first platform portion and terminating at a first tip, the first tip being a first free end, wherein the first shank includes a protrusion that extends circumferentially beyond the split-line; and a second split-line stator vane having a second shank with a second platform portion and a second mounting portion extending radially outward of the second platform portion and mounted to the other of the upper casing portion or the lower casing portion of the compressor casing opposite the first split-line stator vane, and a second airfoil extending radially inward of the second platform portion and terminating at a second tip, the second tip being a second free end, wherein the second shank includes a recess that extends circumferentially away from the split-line, the recess being complementary to the protrusion, wherein a leading edge portion of the first airfoil is coupled to the protrusion of the first shank of the first split-line stator vane such that only the leading edge portion of the first airfoil extends circumferentially beyond the split-line.

10. The split-line stator vane assembly of claim 9, wherein the first shank defines a first pressure-side slash face and a first suction-side slash face, wherein the second shank defines a second pressure-side slash face and a second suction-side slash face, and wherein the first pressure-side slash face of the first shank contacts the second suction-side slash face of the second shank.

11. The split-line stator vane assembly of claim 10, wherein the protrusion is defined on the first pressure-side slash face, and wherein the recess is defined on the second suction-side slash face.

12. The split-line stator vane assembly of claim 11, wherein the first suction-side slash face and the second pressure-side slash face are planar surfaces.

13. The split-line stator vane assembly of claim 11, wherein the first pressure-side slash face includes a first planar portion, and wherein the second suction-side slash face includes a second planar portion.

14. The split-line stator vane assembly of claim 13, wherein the first planar portion and the second planar portion are aligned with the split-line, and wherein the protrusion tapers in axial thickness as the protrusion extends circumferentially away from the first planar portion.

15. The split-line stator vane assembly of claim 9, wherein a plurality of stator vanes comprises the split-line stator vane assembly, the plurality of stator vanes comprising a plurality of main-body stator vanes and a plurality of spacers mounted to the compressor casing.

16. The split-line stator vane assembly of claim 15, wherein each main-body stator vane is disposed circumferentially between one of:

two spacers of the plurality of spacers, or one spacer of the plurality of spacers and the split-line stator vane assembly, and wherein the first split-line stator vane and the second split-line stator vane each circumferentially neighbor a respective main-body stator vane.

17. A turbomachine, comprising:

a combustor section;

a turbine section; and a compressor section, the compressor section comprising:

a compressor casing having an upper casing portion coupled to a lower casing portion such that a split-line is defined between the upper casing portion and the lower casing portion; and a plurality of stator vanes circumferentially arranged in a stage of the compressor casing, the plurality of stator vanes comprising a split-line stator vane assembly mounted in the compressor casing at the split-line, the split-line stator vane assembly comprising:

a first split-line stator vane having a first shank with a first platform portion and a first mounting portion extending radially outward of the first platform portion and mounted to one of the upper casing portion or the lower casing portion of the compressor casing, and a first airfoil extending radially inward of the first platform portion and terminating at a first tip, the first tip being a first free end, wherein the first shank includes a protrusion that extends circumferentially beyond the split-line; and a second split-line stator vane having a second shank with a second platform portion and a second mounting portion extending radially outward of the second platform portion and mounted to the other of the upper casing portion or the lower casing portion of the compressor casing opposite to the first split-line stator vane, and a second airfoil extending radially inward of the second platform portion and terminating at a second tip, the second tip being a second free end, wherein the second shank includes a recess that extends away from the split-line, the recess being complementary to the protrusion, wherein a leading edge portion of the first airfoil is coupled to the protrusion of the first shank of the first split-line stator vane such that only the leading edge portion of the first airfoil extends circumferentially beyond the split-line.

18. The compressor section of claim 1, wherein the first airfoil terminates radially at the first tip, and wherein the second airfoil terminates radially at the second tip.

* * * * *